US011805912B2

(12) United States Patent
Zhu

(10) Patent No.: US 11,805,912 B2
(45) Date of Patent: Nov. 7, 2023

(54) FOLDABLE CAMPING CHAIR

(71) Applicant: Jiang Zhu, Zhejiang (CN)

(72) Inventor: Jiang Zhu, Zhejiang (CN)

( * ) Notice: Subject to any disclaimer, the term of this patent is extended or adjusted under 35 U.S.C. 154(b) by 0 days.

(21) Appl. No.: 17/875,405

(22) Filed: Jul. 28, 2022

(65) Prior Publication Data

US 2023/0037907 A1 Feb. 9, 2023

(30) Foreign Application Priority Data

Aug. 7, 2021 (CN) ..... 202121835438.3

(51) Int. Cl.
*A47C 4/28* (2006.01)
*A47C 1/14* (2006.01)
*A47C 9/10* (2006.01)

(52) U.S. Cl.
CPC ..... *A47C 4/28* (2013.01); *A47C 1/14* (2013.01); *A47C 4/286* (2013.01); *A47C 9/10* (2013.01)

(58) Field of Classification Search
CPC .. A47C 4/28; A47C 1/14; A47C 4/286; A47C 9/10; A47C 4/02; A47C 4/30; A47C 4/283
See application file for complete search history.

(56) References Cited

U.S. PATENT DOCUMENTS

| | | | | | |
|---|---|---|---|---|---|
| 509,735 | A * | 11/1893 | Hanson | A47C 4/28 | 297/118 |
| 4,359,244 | A * | 11/1982 | Koehm | A47C 5/10 | 297/16.2 |
| 5,499,857 | A * | 3/1996 | Lynch, Jr. | A47C 4/286 | 297/16.2 |
| 2003/0011217 | A1* | 1/2003 | Le Gette | A47C 4/286 | 297/16.2 |
| 2003/0080592 | A1* | 5/2003 | Isom | A47C 7/66 | 297/16.2 |
| 2013/0106145 | A1* | 5/2013 | Chen | A47C 4/283 | 297/42 |
| 2017/0311723 | A1* | 11/2017 | Lenhart | A47C 4/42 | |
| 2018/0035806 | A1* | 2/2018 | Yang | A47C 4/42 | |
| 2020/0329875 | A1* | 10/2020 | Zhang | A47C 4/18 | |
| 2021/0196048 | A1* | 7/2021 | Leach | A47C 4/286 | |
| 2022/0000268 | A1* | 1/2022 | Davis | A47C 4/42 | |

* cited by examiner

*Primary Examiner* — Robert Canfield

(57) ABSTRACT

A foldable camping chair, including a foldable supporting frame which includes a connecting unit arranged between two front supporting blocks, a rear supporting block and the two front supporting blocks defining a triangular shape, two side connecting rods, and two front connecting rods; two recessed grooves are formed on a front side of the rear supporting block; two ends of each side connecting rod are movably articulated with a corresponding recessed groove and fixedly plugged in a corresponding front supporting block respectively; two ends of each front connecting rod is movably articulated with an end of the connecting unit and a front supporting block respectively; lower and upper ends of each front supporting block are plugged with a front supporting leg and a front supporting rod respectively; lower and upper ends of the rear supporting block are plugged with a rear supporting leg and a rear supporting rod respectively.

10 Claims, 10 Drawing Sheets

FOLDABLE CAMPING CHAIR

BACKGROUND OF THE INVENTION

The present invention relates to the field of outdoor leisure chairs, and more particularly a foldable camping chair.

Camping chairs refer to a type of leisure chair, which is often placed outdoor under tree shades or bridges for users to cool-off and relax.

The camping chairs in the prior art adopt a quadrangular structure as a main supporting structure, wherein the components thereof are connected through spring ropes and controlled to fold under elastic force, thus having poor stability and being necessary to be folded manually against elastic force, which are difficult and inconvenient to use.

BRIEF SUMMARY OF THE INVENTION

It is an object of the present invention to overcome the problems of the prior art, namely having poor stability and being necessary to be folded manually against elastic force, and thus being difficult and inconvenient to use, by providing a foldable camping chair.

To attain the above object, the present invention provides the following technical solutions:

A foldable camping chair, comprising a seat surface and a foldable supporting frame; the foldable supporting frame comprises a connecting unit, a rear supporting block, two front supporting blocks, two side connecting rods, and two front connecting rods; the two front supporting blocks and the rear supporting block are arranged to define three vertices of a triangular plane; two recessed grooves are formed on a front side of the rear supporting block; an end of each side connecting rod is inserted into and in movable articulation with a corresponding recessed groove, and another end of each side connecting rod is fixedly plugged into a corresponding front supporting block; the connecting unit is provided between the two front supporting blocks; two ends of the connecting unit are each being connected to an end of a corresponding front connecting rod in movable articulation, and another end of each front connecting rod is in movable articulation with a corresponding supporting block; a lower end of each front supporting block is plugged with a front supporting leg; each of two sides of a lower end of the rear supporting block is plugged with a rear supporting leg; an upper end of each front supporting block is plugged with a front supporting rod; each of two sides of an upper end of the rear supporting block is plugged with a rear supporting rod; four sleeve parts are provided on a rear side of the seat surface; upper ends of the front supporting rods and upper ends of the rear supporting rods are fitted into the sleeve parts respectively.

Further, the two front supporting blocks, the two side connecting rods, the two front connecting rods, the two front supporting legs, the two rear supporting legs, the two front supporting rods, and the two rear supporting rods are all arranged in bilateral symmetry respectively.

Further, the two front supporting legs are inclined downward from a front side of the foldable supporting frame towards a left outward direction and a right outward direction respectively with respect to the foldable supporting frame, and a distance between the two front supporting legs gradually widens from top to bottom; the two rear supporting legs are inclined downward from a rear side of the foldable supporting frame towards a left outward direction and a right outward direction respectively with respect to the foldable supporting frame, and a distance between the two rear supporting legs gradually widens from top to bottom; the two front supporting rods are inclined upward from a front side of the foldable supporting frame towards a left outward direction and a right outward direction respectively with respect to the foldable supporting frame, and a distance between the two front supporting rods gradually widens from bottom to top; the two rear supporting rods are inclined upward from a rear side of the foldable supporting frame towards a left outward direction and a right outward direction respectively with respect to the foldable supporting frame, and a distance between the two rear supporting rods gradually widens from bottom to top.

Further, a minimum distance between the two front supporting legs is greater than a maximum distance between the two rear supporting legs; a minimum distance between the two front supporting rods is greater than a minimum distance between the two rear supporting rods and smaller than a maximum distance between the two rear supporting rods.

Further, the two ends of the connecting unit are each provided with a first opening groove, which is opened towards a direction away from the rear supporting block; said end of each front connecting rod is inserted into a corresponding first opening groove and is in movable articulation with the corresponding first opening groove by a rivet; a side of each front supporting block facing another front supporting block is provided with a second opening groove, which is opened towards the rear supporting block; said another end of each front connecting rod is inserted into a corresponding second opening groove, and is in movable articulation with the corresponding second opening groove by a rivet.

Further, each front supporting block is provided with a first upper plugging hole, a first lower plugging hole, and a side plugging hole; a lower end of each front supporting rod is inserted into and in detachable interference fit with a corresponding first upper plugging hole; an upper end of each front supporting leg is inserted into and in detachable interference fit with a corresponding first lower plugging hole; a front end of each side connecting rod is inserted into a corresponding side plugging hole and fixedly connected to the corresponding side plugging hole by a rivet; the rear supporting block is provided with two second upper plugging holes and two second lower plugging holes; a lower end of each rear supporting rod is inserted into and in detachable interference fit with a corresponding second upper plugging hole; an upper end of each rear supporting leg is inserted into and in detachable interference fit with a corresponding second lower plugging hole.

Further, the first upper plugging hole and the first lower plugging hole of each front supporting block are passed through by a first connecting rope, which is configured to connect a corresponding front supporting rod and front supporting leg of each front supporting block; the two second upper plugging holes of the rear supporting block are passed through by a second connecting rope, which is configured to connect the two rear supporting rods of the rear supporting block; the two second lower plugging holes of the rear supporting block are passed through by a third connecting rope, which is configured to connect the two rear supporting legs of the rear supporting block.

Further, the connecting unit has a convex structure; a holding part is provided on a middle of a front end of the connecting unit for a user to hold.

Further, the two recessed grooves are arranged in bilateral symmetry; a rear end of each side connecting rod is inserted into a corresponding recessed groove, and is in movable articulation with the corresponding recessed groove by a rivet.

Further, the seat surface is made of a flexible and foldable material; a concave space is formed on a front side of the seat surface 1 configured for a user to sit and lean on.

In comparison to the prior art, the beneficial effects of the present invention are as follows:

The foldable supporting frame of the foldable camping chair of the present invention has a triangular structure, wherein the components thereof are being fixed or articulated by rivets, which provides stable support; and the folding process can be completed by pushing the connecting unit only, thus being easy and convenient to use.

DETAILED DESCRIPTION OF THE INVENTION

Figure 1:
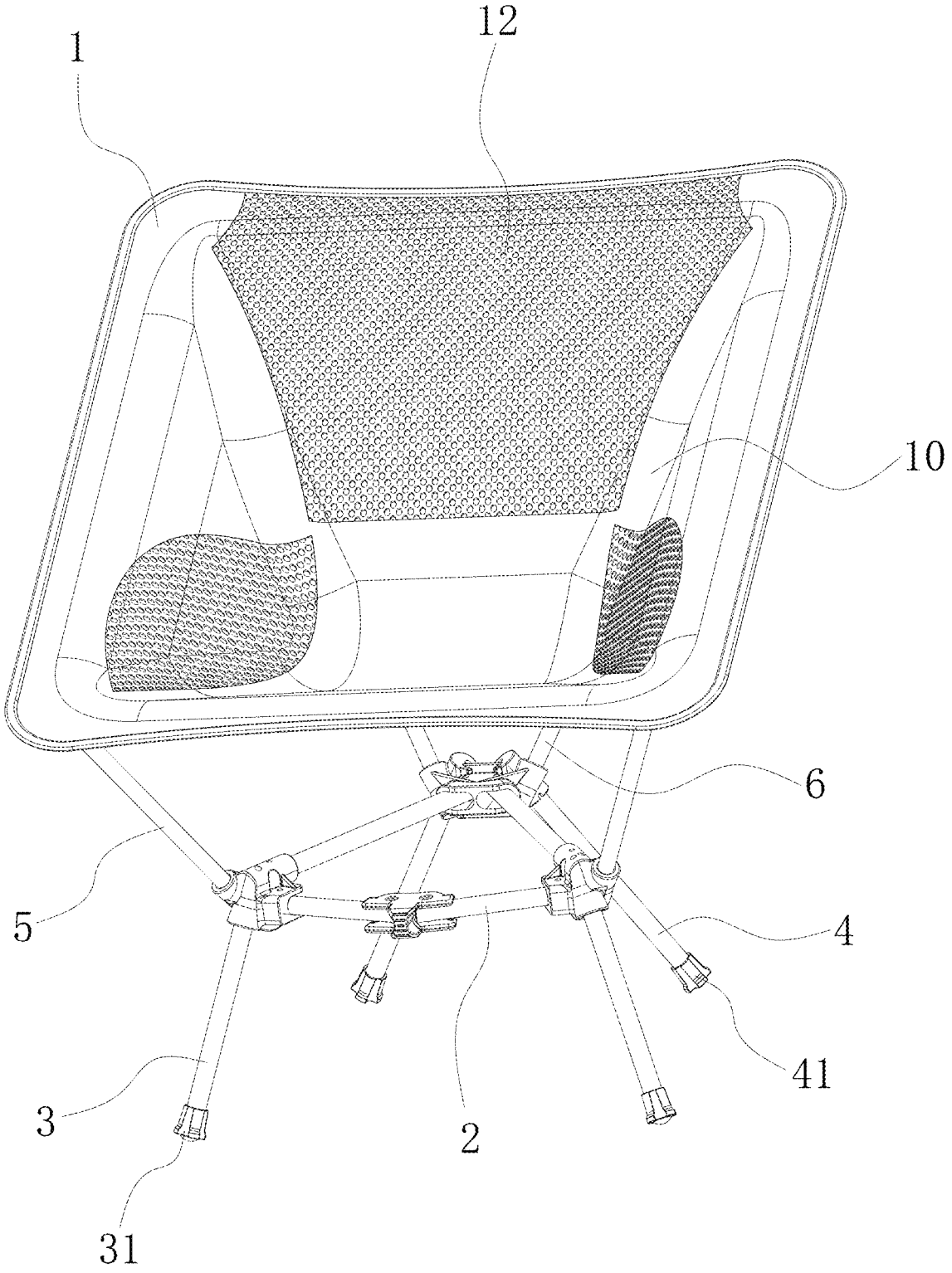
FIG. 1 shows a front perspective view of the foldable camping chair of the present invention.
Figure 2:
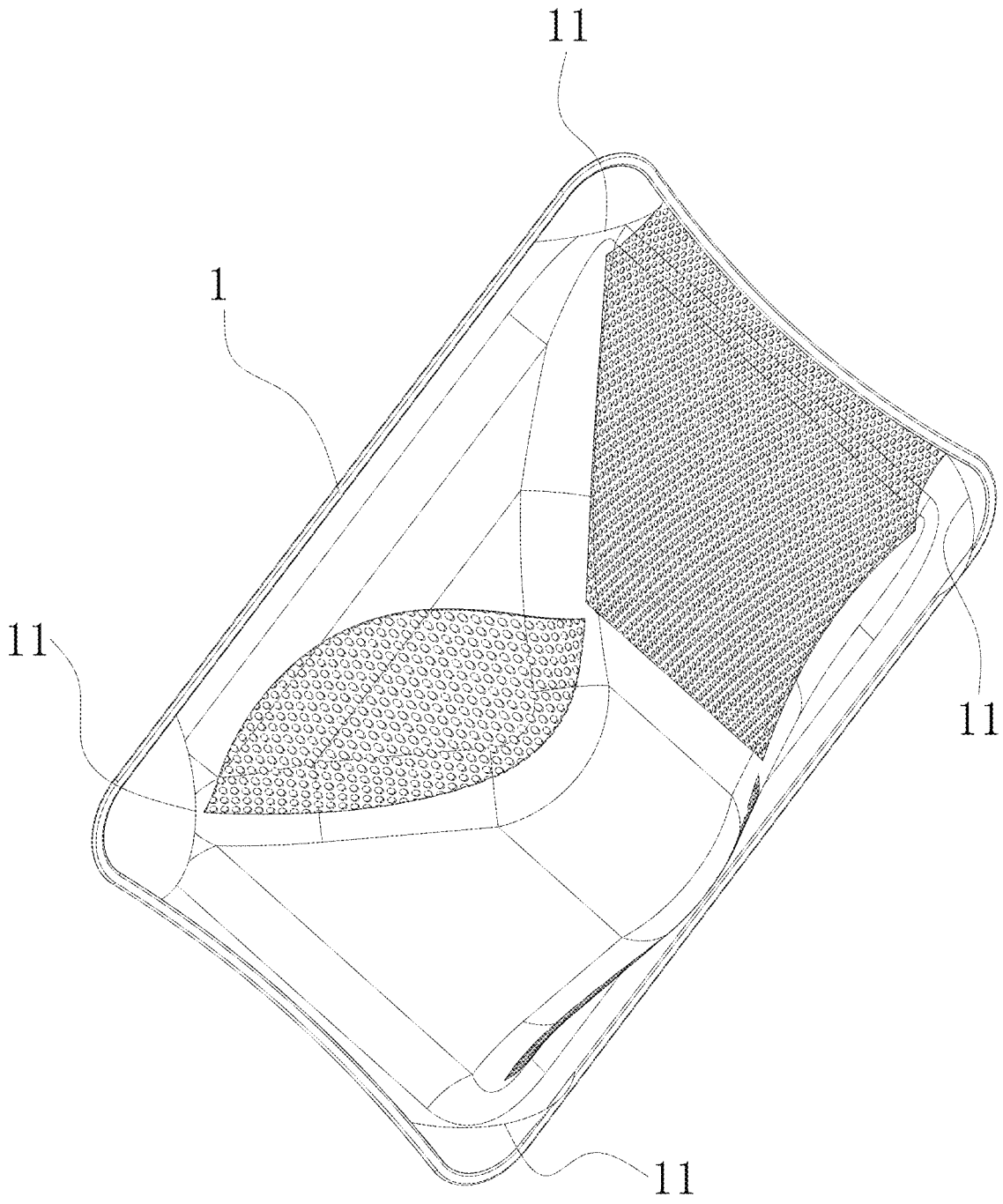
FIG. 2 shows a bottom perspective view of the seat surface of the present invention.
Figure 3:
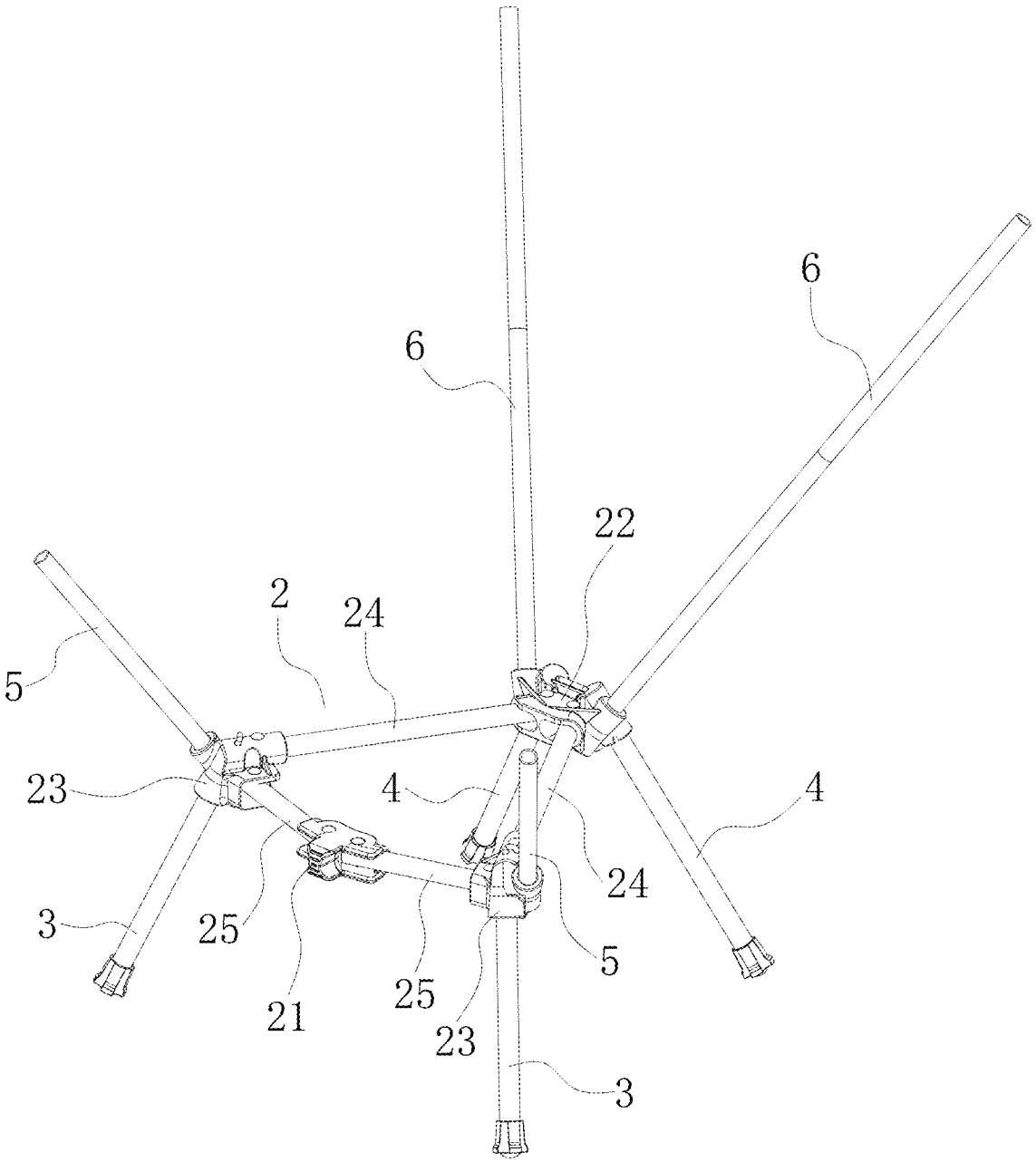
FIG. 3 shows a front perspective view of the seat frame of the present invention.

The following describes in detail the present invention with reference to the accompanying drawings and embodiments.

As illustrated in FIGS. 1, 2, 3 and 6, the present invention provides a foldable camping chair, comprising a seat surface 1 and a foldable supporting frame 2.

The foldable supporting frame 2 comprising a connecting unit 21, a rear supporting block 22, two front supporting blocks 23, two side connecting rods 24, and two front connecting rods 25; the two front supporting blocks 23 and the rear supporting block 22 are arranged to define three vertices of a triangular plane; two recessed grooves 223 are formed on a front side of the rear supporting block 22; an end of each side connecting rod 24 is inserted into and in movable articulation with a corresponding recessed groove 223, and another end of each side connecting rod 24 is fixedly plugged into a corresponding front supporting block 23; the connecting unit 21 is provided between the two front supporting blocks 23; two ends of the connecting unit 21 are each being connected to an end of a corresponding front connecting rod 25 in movable articulation, and another end of each front connecting rod 25 is in movable articulation with a corresponding supporting block 23.

A lower end of each front supporting block 23 is plugged with a front supporting leg 3; each of two sides of a lower end of the rear supporting block 22 is plugged with a rear supporting leg 4; an upper end of each front supporting block 23 is plugged with a front supporting rod 5; each of two sides of an upper end of the rear supporting block 22 is plugged with a rear supporting rod 6; in other words, the front supporting legs 3, the rear supporting legs 4, the front supporting rods 5 and the rear supporting rods 6 are all provided in pairs; a seat frame of the foldable camping chair of the present invention is defined by the front supporting legs 3, the rear supporting legs 4, the front supporting rods 5, the rear supporting rods 6, and the foldable supporting frame 2.

The seat surface 1 is made of a flexible and foldable material, such as a flexible cloth; a concave space 10 is formed on a front side of the seat surface 1 for a human body to sit and lean on; a plurality of air holes 12 are provided on the seat surface 1 for the comfort of the human body when sitting and leaning; four sleeve parts 11 are provided on a rear side of the seat surface 1; upper ends of the front supporting rods 5 and upper ends of the rear supporting rods 6 are fitted into the sleeve parts 11 respectively, so as to fix the seat surface 1 to the foldable supporting frame 2; when detaching the seat surface 1 from the foldable supporting frame 2, it is only necessary to separate the front supporting rods 5 and the rear supporting rods 6 from the sleeve parts 11.

The two front supporting blocks 23, the two side connecting rods 24, the two front connecting rods 25, the two front supporting legs 3, the two rear supporting legs 4, the two front supporting rods 5 and the two rear supporting rods 6 are all arranged in bilateral symmetry.

Figure 4:
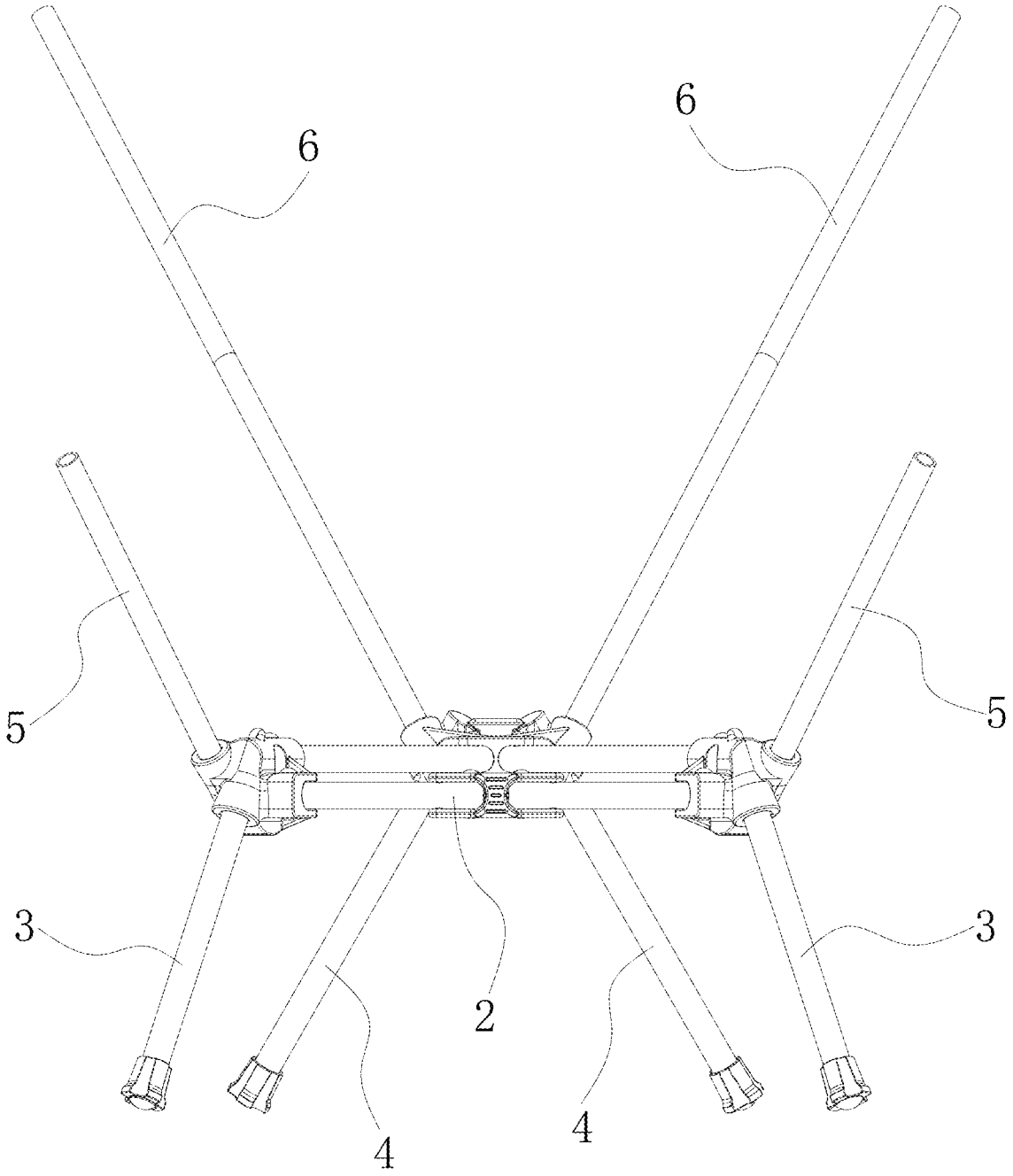
FIG. 4 shows a front view of the seat frame of the present invention.
Figure 5:
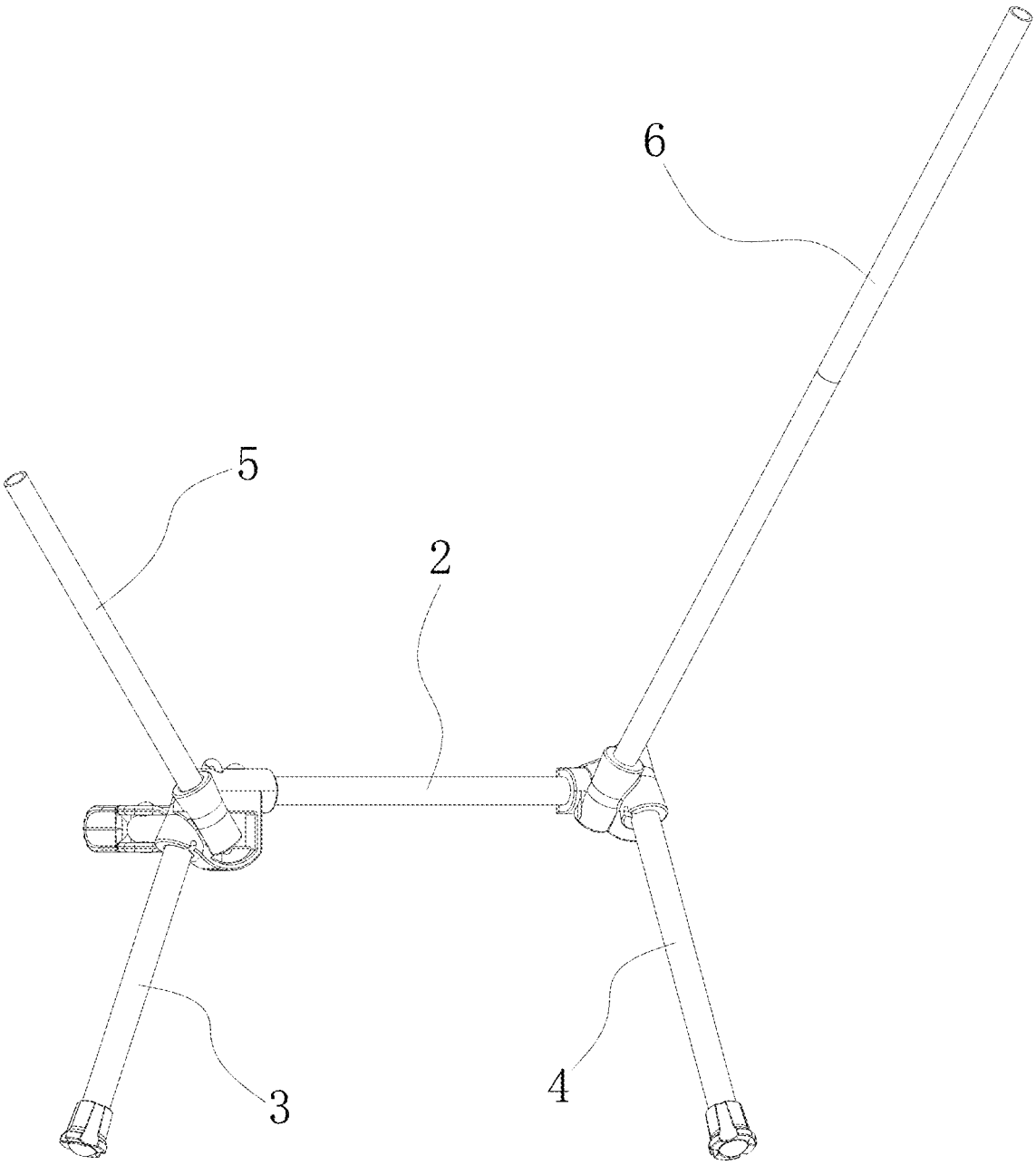
FIG. 5 shows a right view of the seat frame of the present invention.
Figure 6:
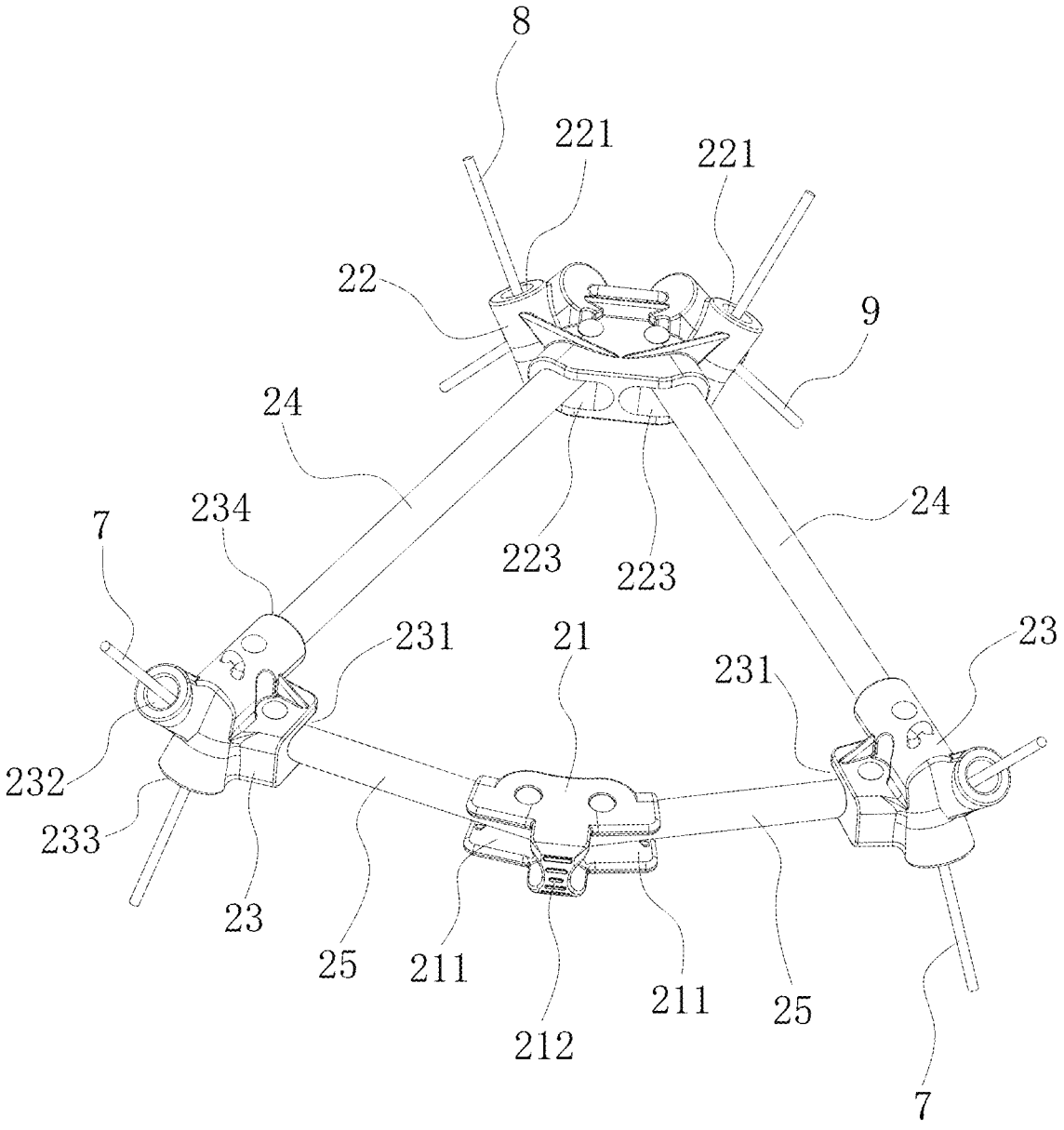
FIG. 6 shows a perspective view of the foldable supporting frame of the present invention.
Figure 7:
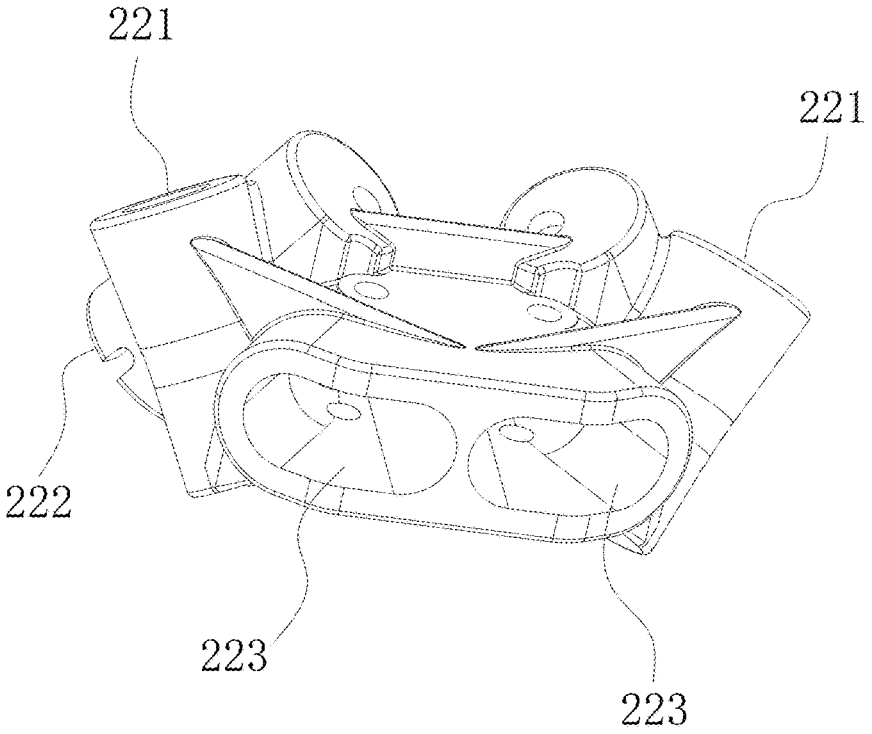
FIG. 7 shows a front perspective view of the rear supporting block of the present invention.
Figure 8:
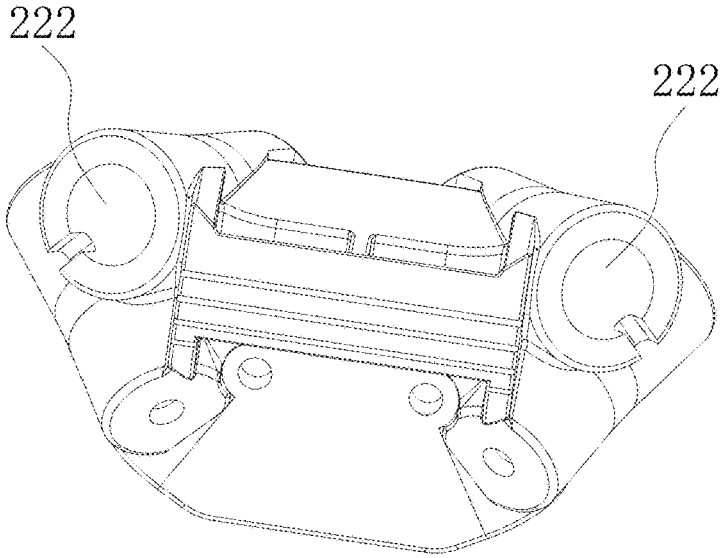
FIG. 8 shows a bottom perspective view of the rear supporting block of the present invention.
Figure 9:
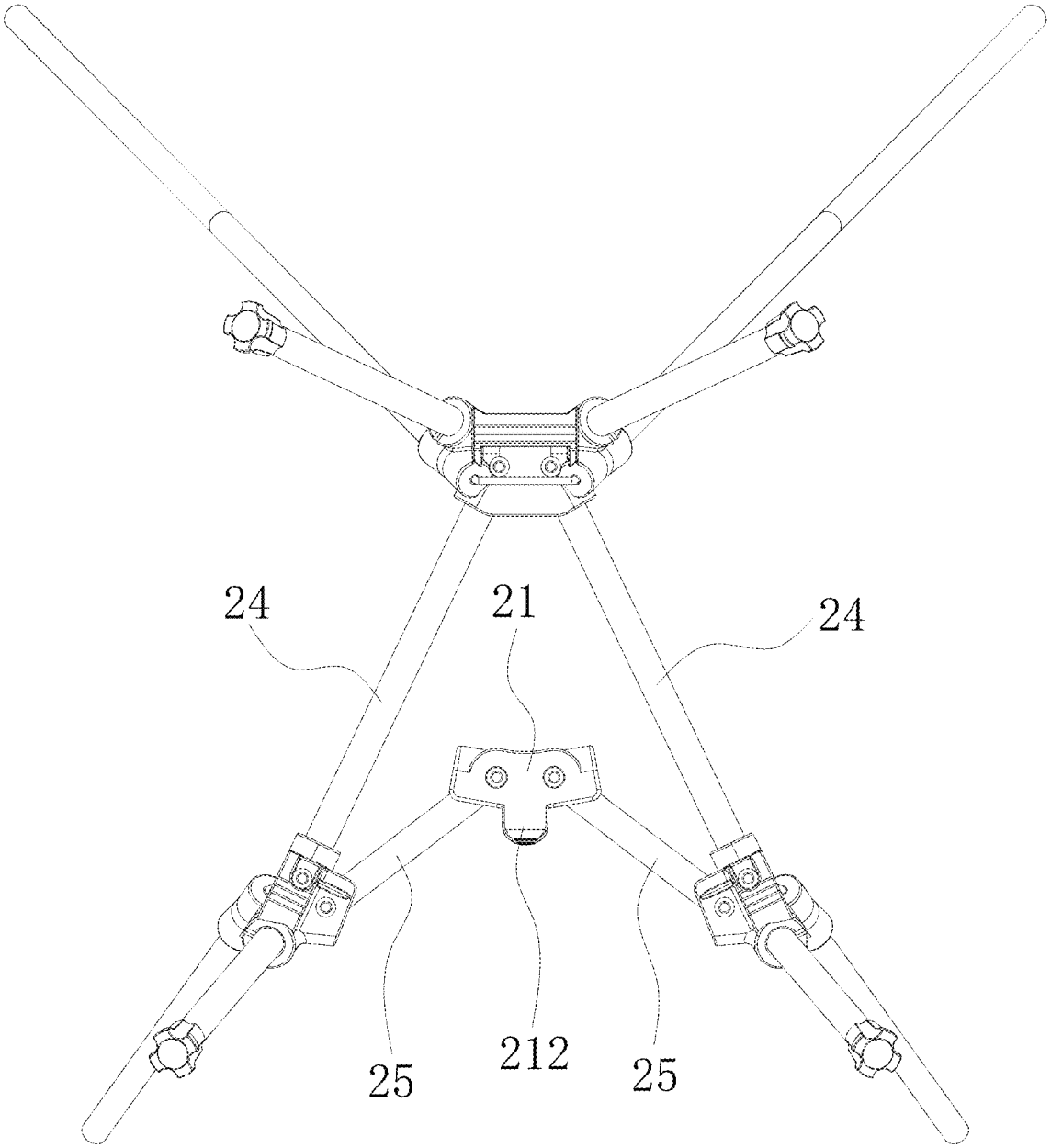
FIG. 9 shows a first schematic view of folding the seat frame of the present invention, wherein the foldable supporting frame starts folding.
Figure 10:
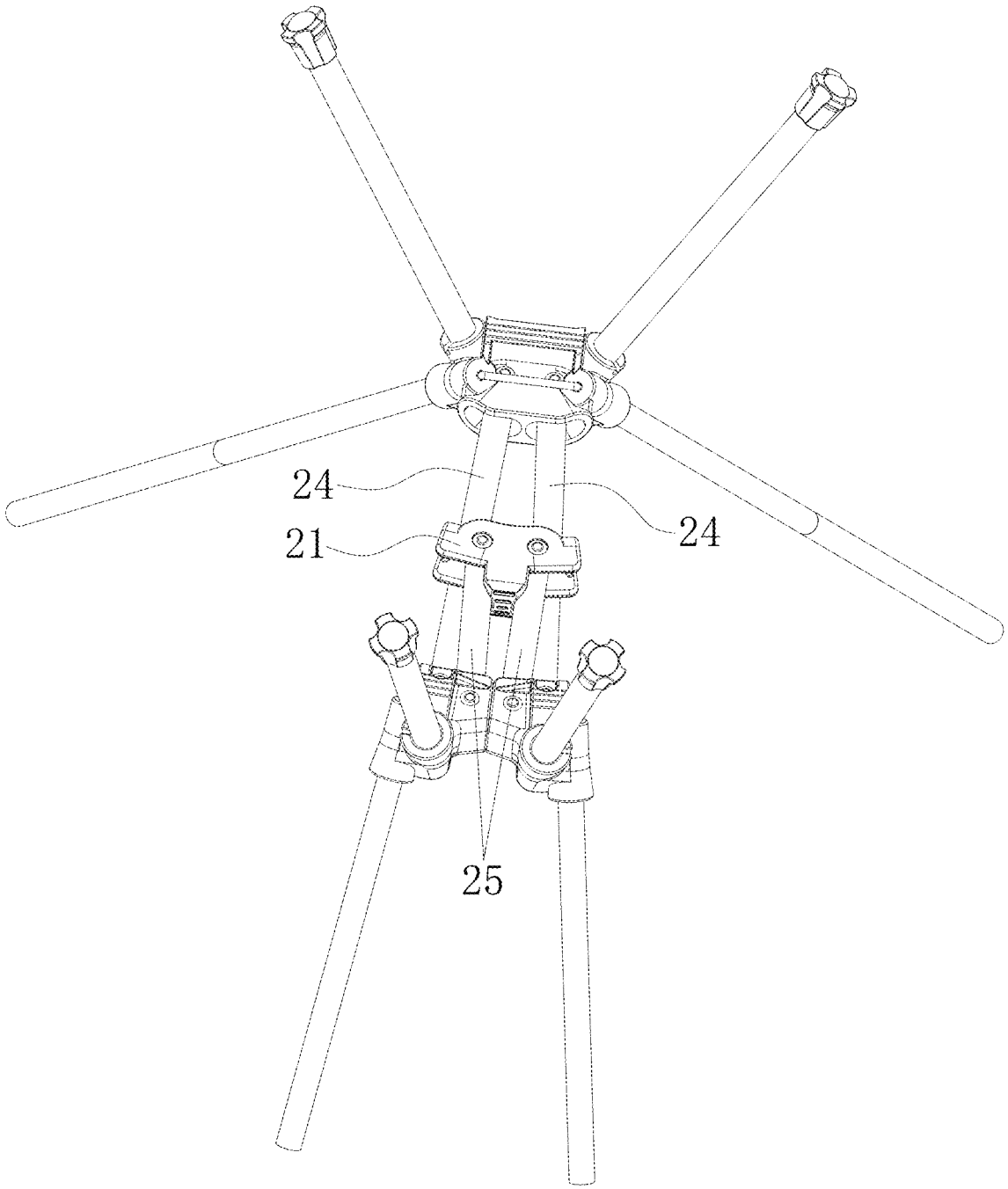
FIG. 10 shows a second schematic view of the seat frame of the present invention, wherein the foldable supporting frame is in a completely folded state.
Figure 11:
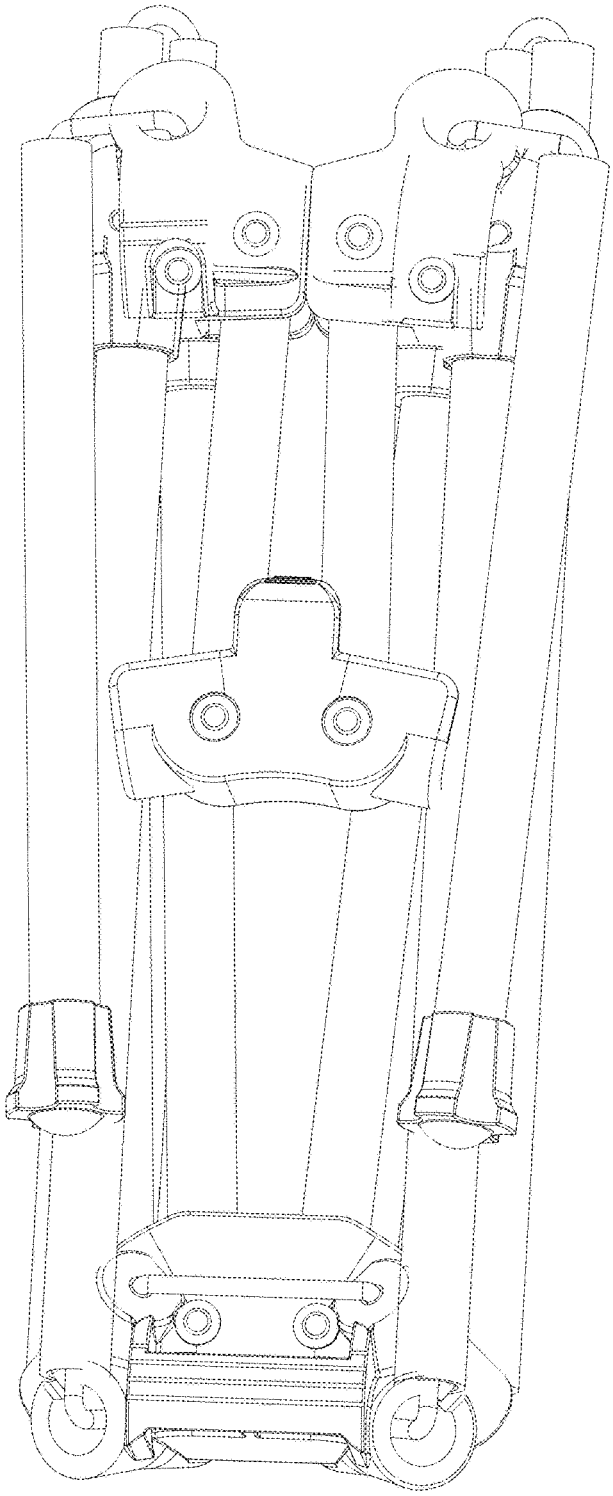
FIG. 11 shows a third schematic view of the seat frame of the present invention, wherein the foldable supporting frame, the front supporting legs, the rear supporting legs, the front supporting rods and the rear supporting rods are in a folded state.

As illustrated in FIGS. 4-5, the two front supporting legs 3 are inclined downward from a front side of the foldable supporting frame 2 towards a left outward direction and a right outward direction respectively with respect to the foldable supporting frame, and a distance between the two front supporting legs 3 gradually widens from top to bottom; the two rear supporting legs 4 are inclined downward from a rear side of the foldable supporting frame 2 towards a left outward direction and a right outward direction respectively with respect to the foldable supporting frame, and a distance between the two rear supporting legs 4 gradually widens from top to bottom; the two front supporting rods 5 are inclined upward from a front side of the foldable supporting frame 2 towards a left outward direction and a right outward direction respectively with respect to the foldable supporting frame, and a distance between the two front supporting rods 5 gradually widens from bottom to top; the two rear supporting rods 6 are inclined upward from a rear side of the foldable supporting frame 2 towards a left outward direction and a right outward direction respectively with respect to the foldable supporting frame, and a distance between the two rear supporting rods 6 gradually widens from bottom to top.

A minimum distance between the two front supporting legs 3 is greater than a maximum distance between the two rear supporting legs 4; a minimum distance between the two front supporting rods 5 is greater than a minimum distance between the two rear supporting rods 6 and smaller than a maximum distance between the two rear supporting rods 6.

As illustrated in FIGS. 3, 6, 7 and 8, the two ends of the connecting unit 21 are each provided with a first opening groove 211, which is opened towards a direction away from the rear supporting block 22; said end of each front connecting rod 25 is inserted into a corresponding first opening groove 211, and is in movable articulation with the corresponding first opening groove 211 by a rivet; a side of each front supporting block 23 facing another front supporting block 23 is provided with a second opening groove 231, which is opened towards the rear supporting block 22; said another end of each front connecting rod 25 is inserted into a corresponding second opening groove 231, and is in movable articulation with the corresponding second opening groove 231 by a rivet.

Each front supporting block 23 is provided with a first upper plugging hole 232, a first lower plugging hole 233, and a side plugging hole 234; a lower end of each front supporting rod 5 is inserted into and in detachable interference fit with a corresponding first upper plugging hole 232; an upper end of each front supporting leg 3 is inserted into and in detachable interference fit with a corresponding first lower plugging hole 233; a front end of each side connecting rod 24 is inserted into a corresponding side plugging hole 234 and fixedly connected to the corresponding side plugging hole 234 by a rivet; the rear supporting block 22 is provided with two second upper plugging holes 221 and two second lower plugging holes 222; a lower end of each rear supporting rod 6 is inserted into and in detachable interference fit with a corresponding second upper plugging hole 221; an upper end of each rear supporting leg 4 is inserted into and in detachable interference fit with a corresponding second lower plugging hole 222.

The first upper plugging hole 232 and the first lower plugging hole 233 of each front supporting block 23 are passed through by a first connecting rope 7, which is configured to connect a corresponding front supporting rod 5 and front supporting leg 3 of each front supporting block 23; the two second upper plugging holes 221 of the rear supporting block 22 are passed through by a second connecting rope 8, which is configured to connect the two rear supporting rods 6 of the rear supporting block 22; the two second lower plugging holes 222 of the rear supporting block 22 are passed through by a third connecting rope 9, which is configured to connect the two rear supporting legs 4 of the rear supporting block 22.

The connecting unit 21 has a convex structure; a holding part 212 is provided on a middle of a front end of the connecting unit 21 for a user to hold.

The two recessed grooves 223 are arranged in bilateral symmetry; a rear end of each side connecting rod 24 is inserted into a corresponding recessed groove 223 and in movable articulation with the corresponding recessed groove 223 by a rivet; each recessed groove 223 has a certain width, so that the corresponding side connecting rod 24 is capable of moving between an unfolded state and a folded state.

As illustrated in FIG. 1, a lower end of each front supporting leg 3 is provided with a front supporting foot 31; a lower end of each rear supporting leg 4 is provided with a rear supporting foot 41; a bottom part of each front supporting foot 31 and rear supporting foot 41 is in a spherical structure, which provides support on the ground with different angles, and is suitable for different ground conditions.

As illustrated in FIGS. 1, 9, 10 and 11, when the foldable camping chair needs to be folded for storage, first detach the seat surface 1 from the foldable supporting frame 2, and fold up the seat surface 1, and then fold up the foldable supporting frame 2; a folding process of the foldable supporting frame 2 comprises the following steps: a user pushes back the connecting unit 21 by pushing the holding part 212, thus driving each of the two front connecting rods 25 to rotate backward about a fulcrum at a point of articulation at said another end thereof, and hence driving each of the two side connecting rods 24 to rotate inward about a fulcrum at a point of articulation at the rear end thereof, thereby bringing the two side connecting rods together; after folding up the foldable supporting frame 2, unplug the two front supporting legs 3, the two rear supporting legs 4, the two front supporting rods 5 and the two rear supporting rods 6 from the plugging holes of the two front supporting blocks 23 and the rear supporting block 22, and stack with the foldable supporting frame 2 which has been folded up in the aforementioned steps; at this time, under the connecting effects of the first connecting ropes 7, the second connecting rope 8 and the third connecting rope 9, the two front supporting legs 3, the two rear supporting legs 4, the two front supporting rods 5 and the two rear supporting rods 6 will not fall off from the foldable supporting frame 2 after being unplugged from the plugging holes, which is convenient for the storage of the supporting legs and supporting rods.

What is claimed is:

1. A foldable camping chair, comprising a seat surface and a foldable supporting frame; wherein:

the foldable supporting frame comprises a connecting unit, a rear supporting block, two front supporting blocks, two side connecting rods, and two front connecting rods; the two front supporting blocks and the rear supporting block are arranged to define three vertices of a triangular plane; two recessed grooves are formed on a front side of the rear supporting block; an end of each side connecting rod is inserted into and in movable articulation with a corresponding recessed groove, and another end of each side connecting rod is fixedly plugged into a corresponding front supporting block;

the connecting unit is provided between the two front supporting blocks; two ends of the connecting unit are each being connected to an end of a corresponding front connecting rod in movable articulation, and another end of each front connecting rod is in movable articulation with a corresponding supporting block;

a lower end of each front supporting block is plugged with a front supporting leg; each of two sides of a lower end of the rear supporting block is plugged with a rear supporting leg; an upper end of each front supporting block is plugged with a front supporting rod; each of two sides of an upper end of the rear supporting block is plugged with a rear supporting rod;

four sleeve parts are provided on a rear side of the seat surface; upper ends of the front supporting rods and upper ends of the rear supporting rods are fitted into the sleeve parts respectively.

2. The foldable camping chair of claim 1, wherein the two front supporting blocks, the two side connecting rods, the two front connecting rods, the two front supporting legs, the two rear supporting legs, the two front supporting rods, and the two rear supporting rods are all arranged in bilateral symmetry respectively.

3. The foldable camping chair of claim 1, wherein the two front supporting legs are inclined downward from a front side of the foldable supporting frame towards a left outward direction and a right outward direction respectively with respect to the foldable supporting frame, and a distance between the two front supporting legs gradually widens from top to bottom; the two rear supporting legs are inclined downward from a rear side of the foldable supporting frame towards a left outward direction and a right outward direction respectively with respect to the foldable supporting frame, and a distance between the two rear supporting legs gradually widens from top to bottom; the two front supporting rods are inclined upward from a front side of the foldable supporting frame towards a left outward direction and a right outward direction respectively with respect to the foldable supporting frame, and a distance between the two front supporting rods gradually widens from bottom to top; the two rear supporting rods are inclined upward from a rear side of the foldable supporting frame towards a left outward direction and a right outward direction respectively with respect to the foldable supporting frame, and a distance between the two rear supporting rods gradually widens from bottom to top.

4. The foldable camping chair of claim 3, wherein a minimum distance between the two front supporting legs is greater than a maximum distance between the two rear supporting legs; a minimum distance between the two front supporting rods is greater than a minimum distance between the two rear supporting rods and smaller than a maximum distance between the two rear supporting rods.

5. The foldable camping chair of claim 1, wherein the two ends of the connecting unit are each provided with a first opening groove, which is opened towards a direction away from the rear supporting block; said end of each front connecting rod is inserted into a corresponding first opening groove and is in movable articulation with the corresponding first opening groove by a rivet; a side of each front supporting block facing another front supporting block is provided with a second opening groove, which is opened towards the rear supporting block; said another end of each front connecting rod is inserted into a corresponding second opening groove, and is in movable articulation with the corresponding second opening groove by a rivet.

6. The foldable camping chair of claim 1, wherein each front supporting block is provided with a first upper plugging hole, a first lower plugging hole, and a side plugging hole; a lower end of each front supporting rod is inserted into and in detachable interference fit with a corresponding first upper plugging hole; an upper end of each front supporting leg is inserted into and in detachable interference fit with a corresponding first lower plugging hole; a front end of each side connecting rod is inserted into a corresponding side plugging hole and fixedly connected to the corresponding side plugging hole by a rivet; the rear supporting block is provided with two second upper plugging holes and two second lower plugging holes; a lower end of each rear supporting rod is inserted into and in detachable interference fit with a corresponding second upper plugging hole; an upper end of each rear supporting leg is inserted into and in detachable interference fit with a corresponding second lower plugging hole.

7. The foldable camping chair of claim 6, wherein the first upper plugging hole and the first lower plugging hole of each front supporting block are passed through by a first connecting rope, which is configured to connect a corresponding front supporting rod and front supporting leg of each front supporting block; the two second upper plugging holes of the rear supporting block are passed through by a second connecting rope, which is configured to connect the two rear supporting rods of the rear supporting block; the two second lower plugging holes of the rear supporting block are passed through by a third connecting rope, which is configured to connect the two rear supporting legs of the rear supporting block.

8. The foldable camping chair of claim 1, wherein the connecting unit has a convex structure; a holding part is provided on a middle of a front end of the connecting unit for a user to hold.

9. The foldable camping chair of claim 1, wherein the two recessed grooves are arranged in bilateral symmetry; a rear end of each side connecting rod is inserted into a corresponding recessed groove, and is in movable articulation with the corresponding recessed groove by a rivet.

10. The foldable camping chair of claim 1, wherein the seat surface is made of a flexible and foldable material; a concave space is formed on a front side of the seat surface 1 configured for a user to sit and lean on.

* * * * *